US008743043B2

(12) United States Patent
Huang et al.

(10) Patent No.: US 8,743,043 B2
(45) Date of Patent: Jun. 3, 2014

(54) METHOD FOR DRIVING SCAN LINES ON DISPLAY DEVICE

(75) Inventors: Chun-Kai Huang, Hsin-Chu (TW); Kung-Yi Chan, Hsin-Chu (TW); Huan-Hsin Li, Hsin-Chu (TW)

(73) Assignee: Au Optronics Corporation, Hsin-Chu (TW)

( * ) Notice: Subject to any disclaimer, the term of this patent is extended or adjusted under 35 U.S.C. 154(b) by 1428 days.

(21) Appl. No.: 12/330,708

(22) Filed: Dec. 9, 2008

(65) Prior Publication Data

US 2009/0256833 A1 Oct. 15, 2009

(30) Foreign Application Priority Data

Apr. 9, 2008 (TW) ..... 97112899 A

(51) Int. Cl.
*G09G 3/36* (2006.01)

(52) U.S. Cl.
USPC ..... 345/100; 345/96; 345/209

(58) Field of Classification Search
USPC ..... 345/96, 100, 209
See application file for complete search history.

(56) References Cited

U.S. PATENT DOCUMENTS

| | | | | |
|---|---|---|---|---|
| 7,015,881 | B2 | 3/2006 | Isobe | |
| 7,109,964 | B2 * | 9/2006 | Pai | 345/96 |
| 8,031,153 | B2 * | 10/2011 | Kang et al. | 345/96 |
| 2002/0063669 | A1 * | 5/2002 | Yanagi et al. | 345/87 |
| 2005/0174310 | A1 * | 8/2005 | Huang et al. | 345/87 |
| 2006/0007094 | A1 * | 1/2006 | Kang et al. | 345/98 |
| 2006/0132405 | A1 * | 6/2006 | Bai et al. | 345/88 |
| 2007/0013631 | A1 * | 1/2007 | Yang | 345/96 |
| 2007/0063952 | A1 * | 3/2007 | Oku et al. | 345/96 |
| 2007/0171175 | A1 * | 7/2007 | Chiang et al. | 345/100 |
| 2008/0012819 | A1 | 1/2008 | Lee et al. | |
| 2008/0100602 | A1 * | 5/2008 | Arai et al. | 345/205 |
| 2008/0224984 | A1 * | 9/2008 | Chang | 345/100 |
| 2009/0179875 | A1 * | 7/2009 | Li et al. | 345/204 |

FOREIGN PATENT DOCUMENTS

CN 101105585 1/2008

OTHER PUBLICATIONS

English language translation of abstract of CN 101105585.

* cited by examiner

*Primary Examiner* — Kwang-Su Yang
(74) *Attorney, Agent, or Firm* — McClure, Qualey & Rodack, LLP

(57) ABSTRACT

A method for driving a display device is provided herein. The display device includes a plurality of scan lines. The method comprises following steps: dividing the scan lines into a plurality of groups, each of which comprises at least two scan lines, i.e. a first and a second scan line; during a first frame period, sequentially enabling the first and second scan line of each group in accordance with a first driving sequence; and during a second frame period, sequentially enabling the first and second scan line of each group in accordance with a second driving sequence, wherein the first driving sequence is different from the second driving sequence.

3 Claims, 15 Drawing Sheets

METHOD FOR DRIVING SCAN LINES ON DISPLAY DEVICE

RELATED APPLICATIONS

This application claims priority to Taiwan Patent Application Serial Number 97112899, filed Apr. 9, 2008, which is herein incorporated by reference.

BACKGROUND

1. Field of Invention

The invention relates to a method for driving a display device, and more particularly, to a method for driving a flat display device.

2. Description of Related Art

In recent years, flat display devices have featured rich color performance that they are widely applied in various fields. Improving the display quality of the flat display device and providing a more stable image with a richer color performance are one of designers' main concerns.

FIG. 1 is a schematic graph of a conventional display device. With reference to FIG. 1, the display device 100 includes a substrate 101, a plurality of pixels 102 and a gate driver 103. The pixels are formed on the substrate 101, the gate driver 103 is connected to the pixels via scan lines 104, and the pixels 102 receive a common voltage signal Vcom by way of common voltage lines 105. During a frame period, the gate driver sequentially provides scanning signals to the scan lines 104 so as to sequentially drive the pixels 102. Meanwhile, the level of the common voltage signal varies according to different design requirements.

However, during the frame period of the display device, the frame would generate a plurality of horizontal lines respectively with different brightness from the side of the viewer. The horizontal lines degrade the display quality and the viewer may thus suffer from visual fatigue.

To solve the aforesaid horizontal line phenomenon, a conventional driving method is implemented. The driving method drives all scan lines according to a driving sequence. FIG. 2 is a time diagram illustrating the conventional driving method. In this conventional driving method, the gate lines G1, G3 and G5 are sequentially driven, and before starting to drive next group of scan lines, the level of the common voltage signals are reversed from high to low. Later, the gate lines G2, G4 and G6 are sequentially driven. Also, before starting to drive next group of scan lines, the level of the common voltage signals are reversed from low to high.

Therefore, a new display device and driving method thereof should be provided with the intention to sufficiently eliminate the phenomenon of the horizontal lines and provide a high-quality frame displayed on the flat display device.

SUMMARY

Accordingly, one aspect of the invention is directed to a method for driving a display device. With the method, the horizontal lines are substantially eliminated so as to acquire a high display quality.

With consideration to the aforesaid aspects, one embodiment of the invention provides a method for driving a display device with a plurality of scan lines. The method comprises dividing the scan lines into a plurality of groups, each group having a first scan line to a $m^{th}$ scan line and m is a positive integer greater than 1, and enabling the first scan line to the $m^{th}$ scan line sequentially respectively in accordance with a first driving sequence to a $m^{th}$ driving sequence in a first frame period to a $m^{th}$ frame period, wherein the first driving sequence and the $m^{th}$ driving sequence are different from each other. That is, during a first frame period, m scan lines of each group are sequentially enabled respectively in accordance with the first driving sequence, and during a second frame period, m scan lines of each group are sequentially enabled respectively in accordance with the second driving sequence, and so on, until all the m frame periods are finished.

Another aspect of the invention is directed to another method for driving a display device. With the method, the horizontal lines are substantially eliminated so as to acquire a high display quality.

In another embodiment of the invention, the method is also provided to drive a display device with a plurality of scan lines. The driving method includes dividing the scan lines into a plurality of groups, wherein each group has at least two scan lines, enabling the scan lines of each of the groups in accordance with a first driving sequence in a first frame period; and enabling the scan lines of each of the groups in accordance with a second driving sequence in a second frame period, wherein the first driving sequence and the second driving sequence are different from each other.

The embodiments of the invention provides a method for driving a display device implementing different driving sequences in different frame periods so as to solve the problem of conventional art and obtain high display quality.

DESCRIPTION OF THE PREFERRED EMBODIMENTS

To eliminate the horizontal line problem, embodiments of the invention provide methods for driving a display device, e.g., a liquid crystal display. However, in other embodiments, the display device could also be a plasma display or an electronic paper display.

Figure 1:
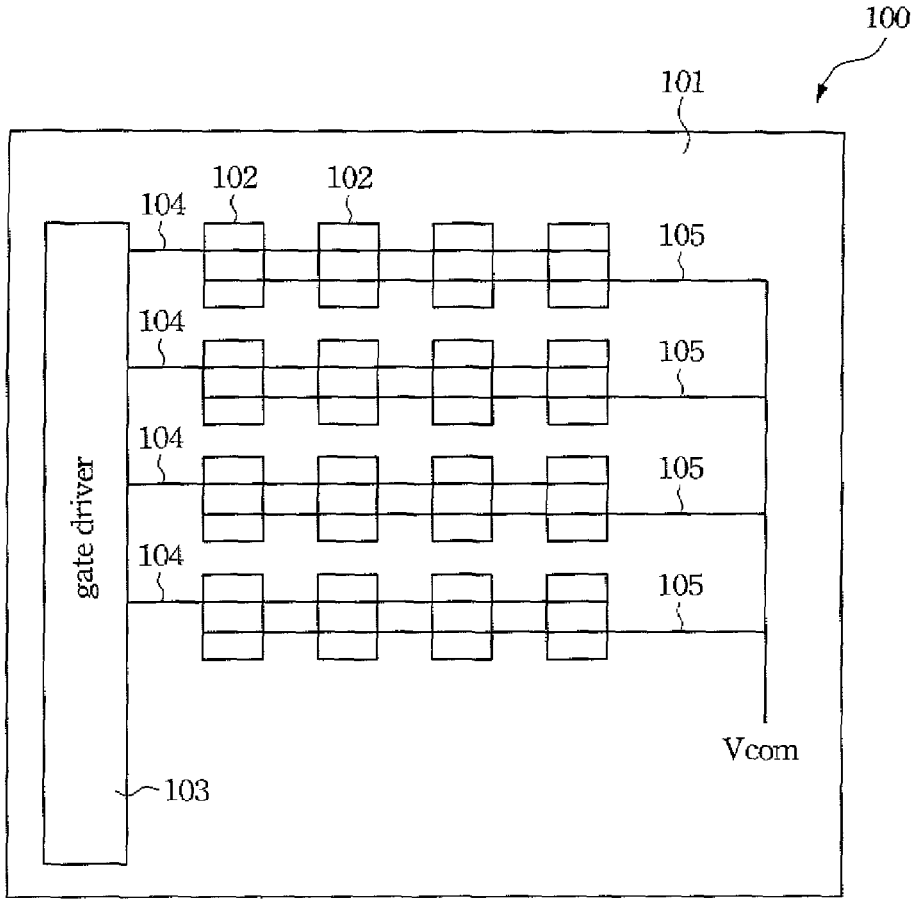
Fig. 1 (PRIOR ART)
FIG. 1 is a schematic graph of a conventional display device.
Figure 2:
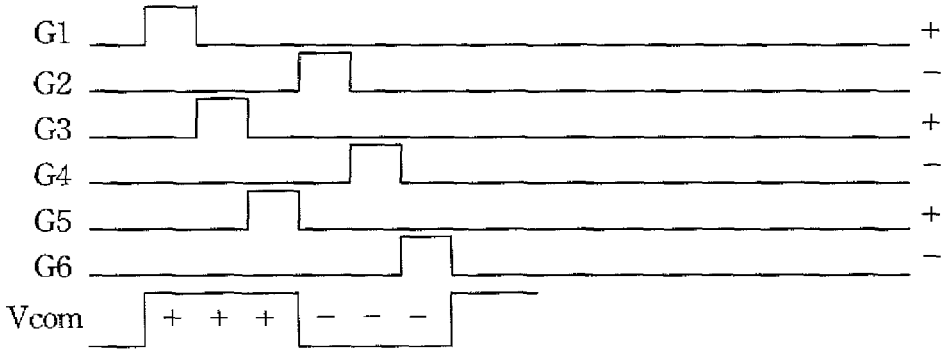
Fig. 2 (PRIOR ART)
FIG. 2 is a timing diagram of a conventional driving method.
Figure 3A:
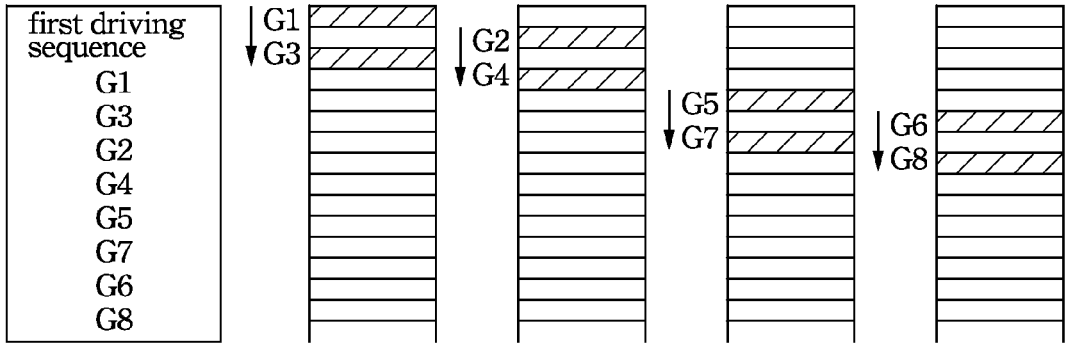
FIG. 3A is a schematic graph illustrating a method for driving a display device during a frame period in accordance with one embodiment of the invention.
Figure 3B:
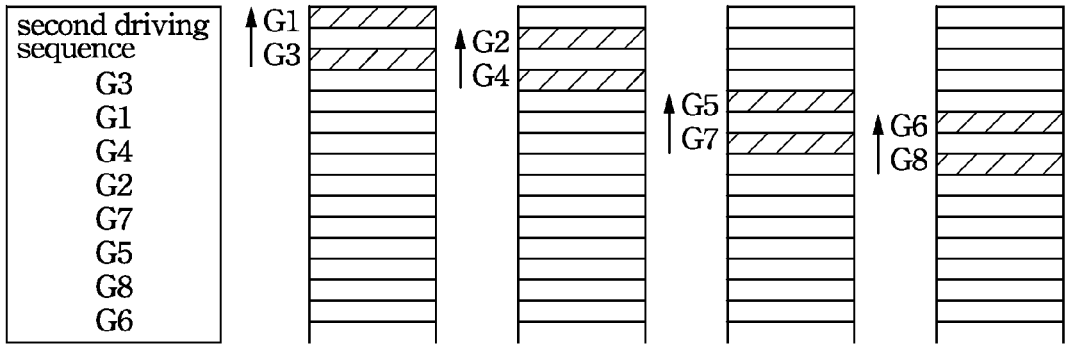
FIG. 3B is a schematic graph illustrating a method for driving a display device during another frame period in accordance with one embodiment of the invention.

FIG. 3A is a schematic graph illustrating a method for driving a display device during a frame period in accordance with one embodiment of the invention. FIG. 3B is a schematic graph illustrating a method for driving a display device during another frame period in accordance with one embodiment of the invention. With reference to FIG. 3A and FIG. 3B, the method is implemented to drive a display device. The display device may, for example, include eight scan lines labeled G1~G8. However, the embodiment is exemplary only, the number of scan lines should not be limited to eight and should be determined in accordance with factual resolution requirements.

In FIG. 3A, each of the scan lines G1 to G8 are sequentially driven in accordance with a first driving sequence, i.e. the first scan line G1, the third scan line G3, the second scan line G2, the fourth scan line G4, the fifth scan line G5, the seventh scan line G7, the sixth scan line G6, and the eighth scan line G8. That is, during the frame period, the first scan line G1 and the third scan line G3 are driven sequentially first, the second scan line G2 and the fourth scan line G4 are driven sequentially second, the fifth scan line G5 and the seventh scan line G7 are driven sequentially third, and the sixth scan line G6 and the eighth scan line G8 are driven sequentially fourth. Note that the scan lines are driven from left to right. According to the embodiment, during another frame period, each of the scan lines are sequentially driven in accordance with a second driving sequence i.e. a third scan line G3, the first scan line G1 the fourth scan line G4, the second scan line G2, the seventh scan line G7, the fifth scan line G5, the eighth scan line G8 and the sixth scan line G6. In other words, during the frame period, the third scan line G3 and the first scan line G1 are driven sequentially first, the fourth scan line G4 and the second scan line G2 are driven sequentially second, the seventh scan line G7 and the fifth scan line G5 are driven sequentially third, and the eighth scan line G8 and the sixth scan line G6 are driven sequentially fourth. Note that the scan lines are driven from left to right.

The scan direction may begin from left to right in FIG. 3A or vice versa. In the case of implementing the scan directions beginning from left and right, the unevenness in the frame is improved. In the embodiment, the scan line are divided into a plurality of groups, each group has two scan lines, e.g., the first scan line G1 and the third scan line G3 belong to a first group, and the second scan line G2 and the fourth scan line G4 belong to a second group.

In the embodiment, during the different frame periods, the first scan line G1 and the third scan line G3 are sequentially driven with the first driving sequence or the second driving sequence.

Since all scan lines on the liquid crystal display are sequentially driven with multiple driving sequences, the horizontal lines are substantially eliminated and the unevenness of the images is prevented, thus the display quality is upgraded.

In the aforesaid embodiment, a display device may be a display panel with a QVGA resolution, the display panel includes 320 gate lines, respectively referred to as G1 to G320. Taking FIG. 3A for example, a complete first driving sequence is G1 and G3→G2 and G4→G5 and G7→G6 and G8 . . . →G317 and G319→G318 and G320. Taking FIG. 3B for example, a complete second driving sequence is G3 and G1→G4 and G2→G7 and G5→G8 and G6 . . . →G319 and G317→G320 and G318. However, it should be noted that the display device of the aforesaid embodiment is illustrative only, and not by way of limitation. For example, the display device may also be a VGA device with a resolution of 480 scan lines, a SVGA device with a resolution of 600 scan lines or an XVGA device with a resolution of 768 scan lines.

Figure 4:
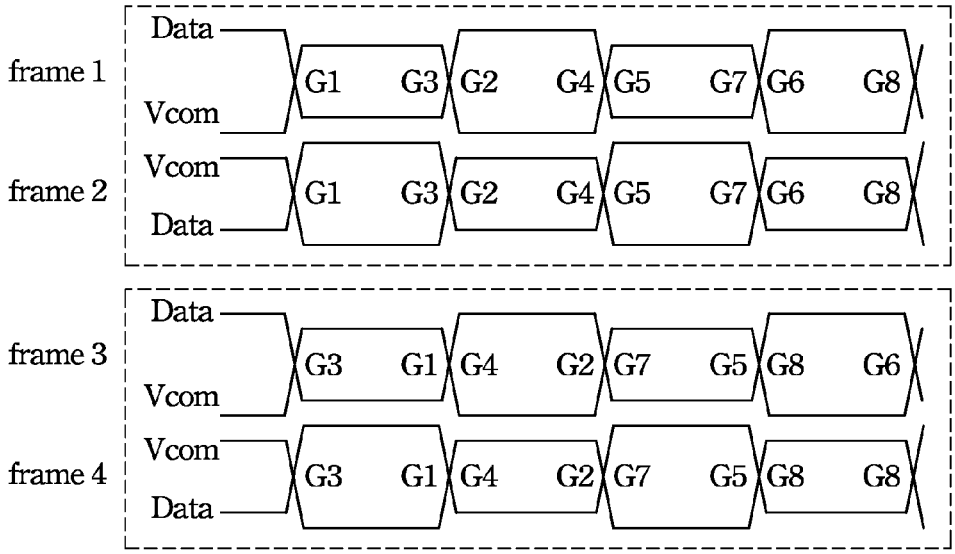
FIG. 4 is a schematic graph illustrating the variation of voltages in a display device in accordance with one embodiment of the invention.

FIG. 4 is a schematic graph illustrating the variation of voltages in a display device in accordance with one embodiment of the invention. It shows driving sequences of scan lines and levels of a common voltage signal. The first driving sequence drives the scan lines G1~G8 during both Frame 1 and Frame 2 periods, and the scan lines G1~G8 are driven respectively with the second driving sequence during both Frame 3 and Frame 4 periods. During the Frame1 and Frame 2 periods, the levels of a common voltage signal are different.

Furthermore, during the Frame 1 period, the level of the data signal voltage Data of the first scan line is high, and the level of the common voltage signal Vcom is low. Also, during the Frame 2 period, the level of the data signal voltage Data of the first scan line is low, and the level of the common voltage signal Vcom is high. It is the same case for other frames, such as Frame 3 and Frame 4 and so on. The related descriptions are omitted for the sake of simplicity.

Figure 5A:
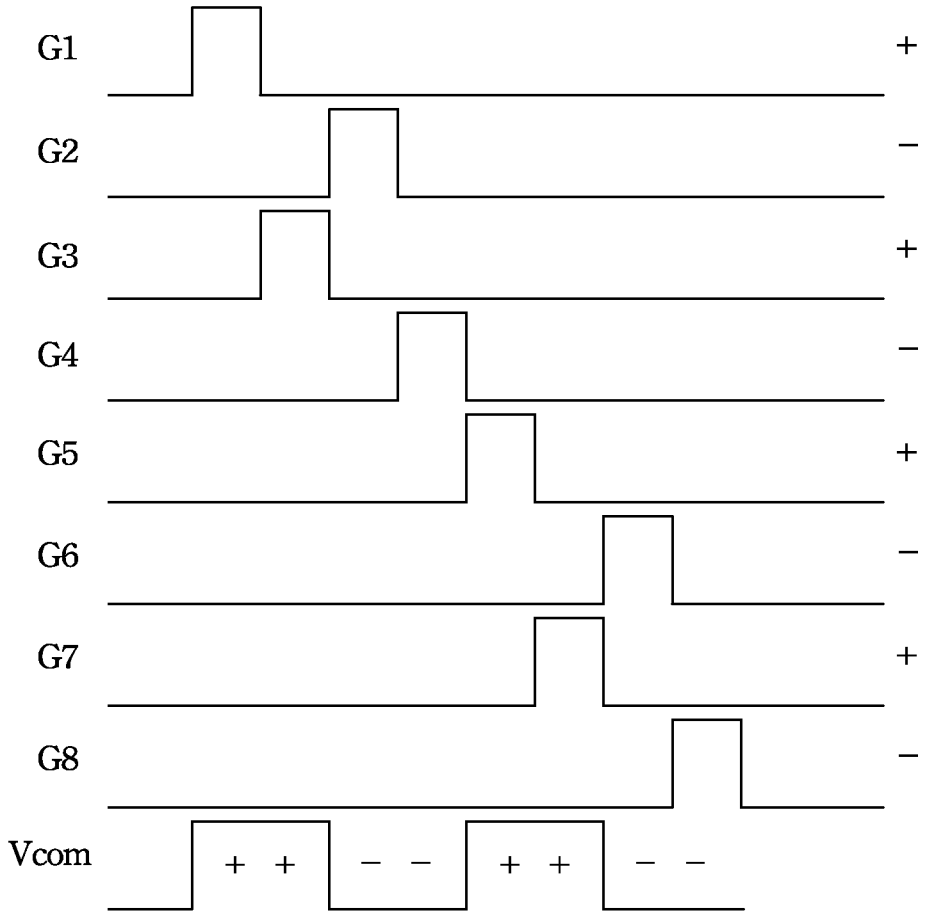
FIG. 5A is a timing diagram showing the method shown in FIG. 3A.
Figure 5B:
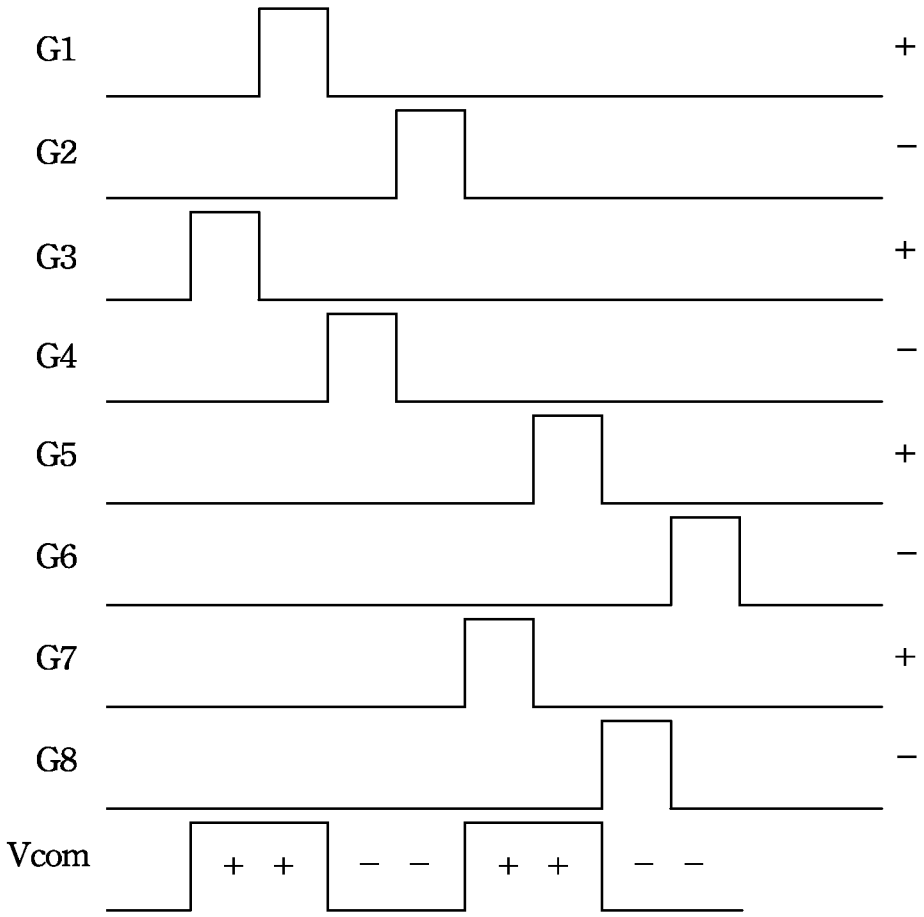
FIG. 5B is a timing diagram showing the method shown in FIG. 3B.

FIG. 5A is a timing diagram showing the method shown in FIG. 3A. FIG. 5B is a timing diagram showing the method shown in FIG. 3B. With reference to FIG. 5A and FIG. 5B, the timing diagram respectively shows scanning signal voltages of the first and the second driving sequences provided by a gate driver (not shown) and corresponding common voltage signal Vcom on common lines (not shown), the scanning signal voltages respectively referred to the voltages on the scan lines G1 to G8. After each group is driven, the common voltage signal will revert the level, i.e., when sequentially driving a first scan line G1 and a third scan line G3 with the first driving sequence, the level of the common voltage signal is high. Later, when sequentially driving a second scan line G2 and a fourth scan line G4 with the first driving sequence, the level of the common voltage signal Vcom is low and so on, until the driving operation for all scan lines is finished.

Namely, when scan lines are driven with the first or the second driving sequence, the level of the common voltage signal is reversed. The reversed level of the common voltage signal could protect the liquid crystal molecule of the liquid crystal display from deterioration.

On the other hand, the embodiment shown in FIGS. 5A and 5B may replace the common voltage signal with another common voltage signal, which may also have different levels. For example, in FIG. 5A, when the first scan line G1 and the third scan line G3 are sequentially driven with the first driving sequence, the common signal with a low level is provided to the pixels corresponding to the scan lines G1 and G3. Later, when the second scan line G2 and the fourth scan line G4 are sequentially driven with the first driving sequence, the level of the common voltage signal Vcom is switched to be high, and the common voltage signal Vcom is provided to the pixels corresponding to the two scan lines G2 and G4 so as to also protect the liquid crystal molecule of the liquid crystal display from deterioration.

Figure 6A:
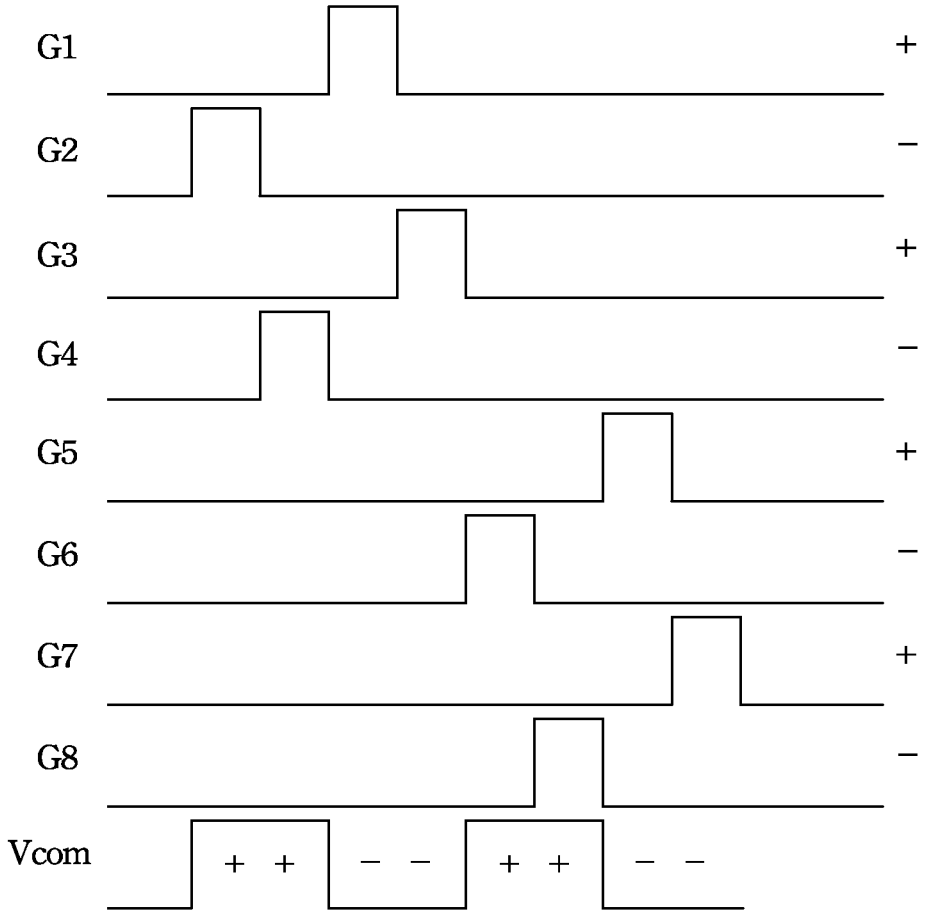
FIG. 6A is a partial timing diagram showing a method for driving a display device in accordance with another embodiment of the invention.
Figure 6B:
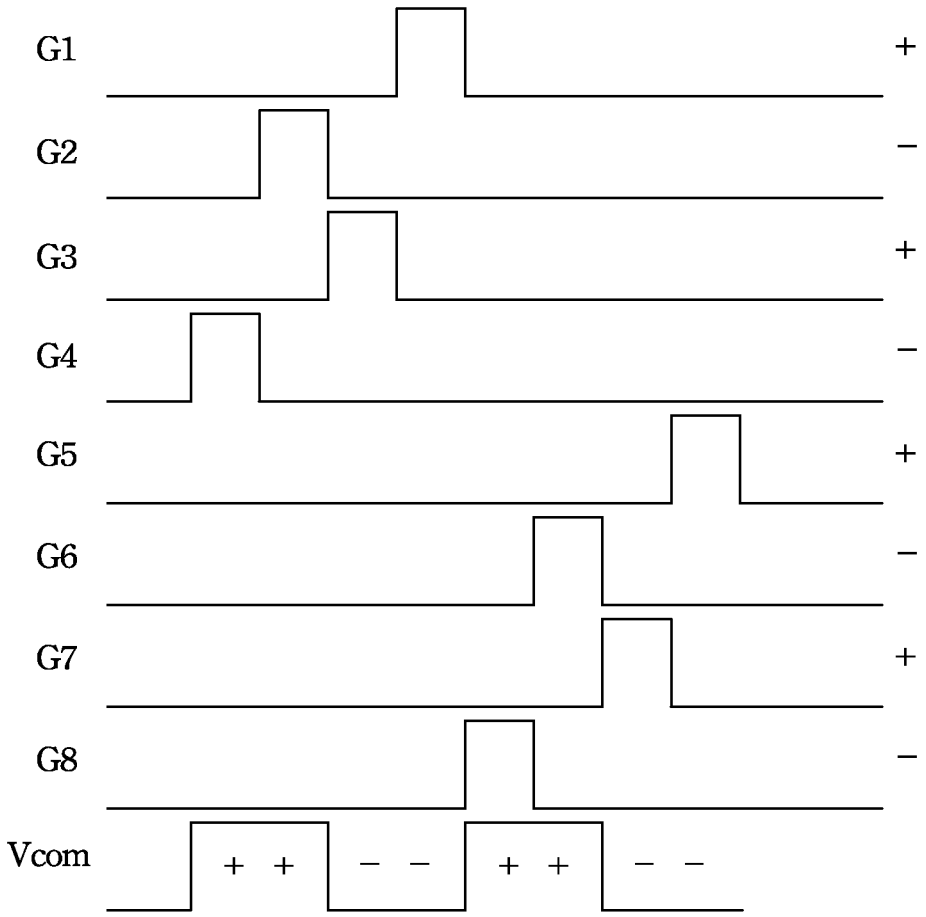
FIG. 6B is another partial timing diagram showing a method for driving a display device in accordance with another embodiment of the invention.

FIG. 6A is a partial timing diagram showing a method for driving a display device in accordance with another embodiment of the invention. FIG. 6B is another partial timing diagram showing a method for driving a display device in accordance with another embodiment of the invention. Referring to FIG. 6A and FIG. 6B, the scan lines are sequentially driven with a first driving sequence in the embodiment. That is, the second, the fourth, the first, the third, the sixth, the eighth, the fifth, the seventh scan lines are sequentially driven with the first driving sequence during the first frame period.

Similarly, in the embodiment, the scan lines G1 to G8 are sequentially driven with a second driving sequence. That is, the fourth, the second, the third, the first, the eighth, the sixth, the seventh, the fifth scan lines are sequentially driven with the second driving sequence during the second frame period.

The voltage signals shown in FIGS. 6A and 6B are illustrative only, in the other embodiment, another common voltage signal with a reversed level could be implemented to replace the common voltage signal. In the embodiment, the second scan line and the fourth scan line are divided into a first group, the first scan line and the third scan line are divided into a second group, the sixth scan line and the eighth scan line are divided into a third group, and the fifth scan line and the seventh scan line are divided into a fourth group. After the scan lines of each group are driven, the level of the common voltage signal is reversed, until all groups are driven.

Also, since all scan lines on the liquid crystal display are sequentially driven with multiple driving sequences, the horizontal lines are substantially eliminated and the unevenness of image is prevented, thus the display quality is upgraded.

In the embodiments, all scan lines are divided into a plurality of groups, each of the groups has two scan lines. In different frame periods, the two scan lines are driven respectively in accordance with the first and the second driving sequences. However, the invention should not be restricted in the embodiment described above. For example, in the following method, each of the groups has three scan lines, and the three scan lines are sequentially driven in accordance with a first, a second, and a third driving sequence.

Figure 7A:
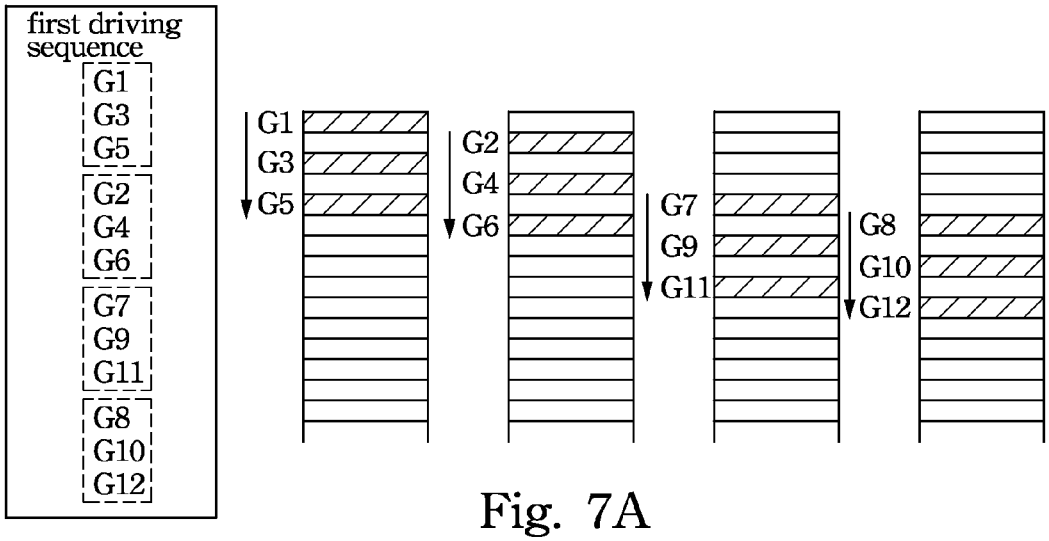
FIG. 7A is a schematic graph illustrating a method for driving a display device during a frame period in accordance with still another embodiment of the invention.
Figure 7B:
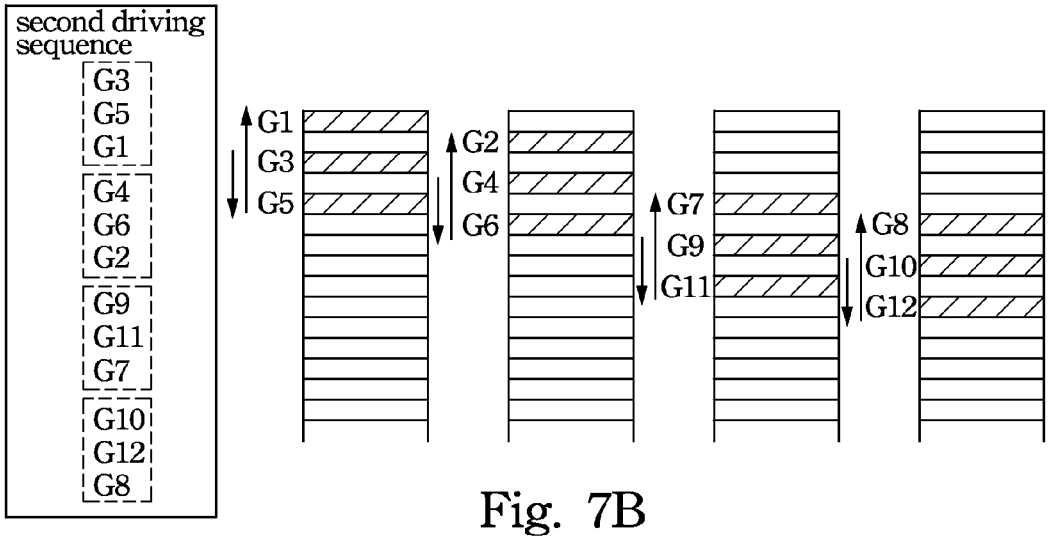
FIG. 7B is a schematic graph illustrating a method for driving a display device during another frame period in accordance with still another embodiment of the invention.
Figure 7C:
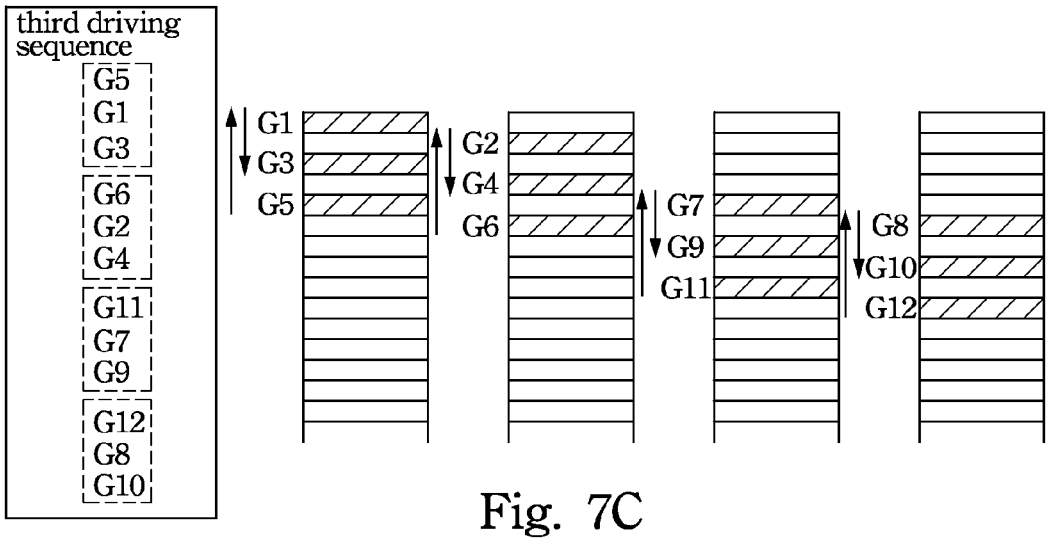
FIG. 7C is a schematic graph illustrating a method for driving a display device during still another frame period in accordance with still another embodiment of the invention.

FIG. 7A is a schematic graph illustrating a method for driving a display device during a frame period in accordance with still another embodiment of the invention. FIG. 7B is a schematic graph illustrating a method for driving a display device during another frame period in accordance with still another embodiment of the invention. FIG. 7C is a schematic graph illustrating a method for driving a display device during still another frame period in accordance with still another embodiment of the invention. The method is implemented for driving a display device, for example, the display device may include twelve scan lines G1 to G12. However, the embodiment is exemplary only, the number of the scan lines should not be limited to twelve, the number of the scan lines should be determined in accordance with actual resolution requirements.

In FIG. 7A, the scan lines G1~G12 are sequentially driven in accordance with a first driving sequence, i.e. a first scan line G1, the third scan line G3, the fifth scan line G5, the second scan line G2, the fourth scan line G4, the sixth scan line G6, the seventh scan line G7, the ninth scan line G9, the eleventh scan line G11, the eighth scan line G8, the tenth scan line G10, and the twelfth scan line G12. In other words, during the frame period, the first scan line G1, the third scan line G3 and the fifth scan line G5 are driven sequentially first; the second scan line G2, the fourth scan line G4 and the sixth scan line G6 are driven sequentially second; the seventh scan line G7, the ninth scan line G9 and the eleventh scan line G11 are driven sequentially third; and the eighth scan line G8, the tenth scan line G10 and the twelfth scan line G12 are driven sequentially fourth. Note that the scan lines are driven from left to right.

The scan direction may begin from left to right in FIG. 7A or vice versa. In the case of implementing the scan directions beginning from left and right, the unevenness in the frame is improved.

As shown in FIG. 7B, in the embodiment, the gate lines G1~G12 are sequentially driven in accordance with a second driving sequence, i.e. a third scan line G3, the fifth scan line G5, the first scan line G1, the fourth scan line G4, the sixth scan line G6, the second scan line G2, the ninth scan line G9, the eleventh scan line G11, the seventh scan line G7, the tenth scan line G10, the twelfth scan line G12 and the eight scan line G8. In other words, during the frame period, the third scan line G3, the fifth scan line G5 and the first scan line G1 are driven sequentially first; the fourth scan line G4, the sixth scan line G6 and the second scan line G2 are driven sequentially second; the ninth scan line G9, the eleventh scan line G11 and the seventh scan line G7 are driven sequentially third; and the tenth scan line G10, the twelfth scan line G12 and the eighth scan line G8 are driven sequentially fourth. Note that the scan lines are driven from left to right.

As shown in FIG. 7C, in the embodiment, the gate lines G1 to G12 are sequentially driven in accordance with a third driving sequence, i.e. a fifth scan line G5, the first scan line G1, the third scan line G3, the sixth scan line G6, the second scan line G2, the fourth scan line G4, the eleventh scan line G11, the seventh scan line G7, the ninth scan line G9, the twelfth scan line G12, the eight scan line G8, and the tenth scan line G10. In other words, during the frame period, the fifth scan line G5, the first scan line G1 and the third scan line G3 are driven sequentially first; the sixth scan line G6, the second scan line G2 and the fourth scan line G4 are driven sequentially second; the eleventh scan line G11, the seventh scan line G7 and the ninth scan line G9 are driven sequentially third; and the twelfth scan line G12, the eighth scan line G8 and the tenth scan line G10 are driven sequentially fourth. Note that the scan lines are driven from left to right.

In the embodiment, the scan line are divided into a plurality of groups, each group having three scan lines, e.g., the first scan line G1, the third scan line G3 and the fifth scan line G5 belong to a first group; the second scan line G2, the fourth scan line G4 and the sixth scan line G6 belong to a second group; the seventh scan line G7, the ninth scan line G9 and the eleventh scan line G11 belong to a third group; and the eighth scan line G8, the tenth scan line G10 and the twelfth scan line G12 belong to a fourth group and so on. In different frame periods, respectively implementing the first, the second and the third driving sequences sequentially drive the scan lines of each group. That is, in the embodiment, during different frame periods, the first scan line G1, the third scan line G3, and the fifth scan line G5 are driven in accordance with the first driving sequence; the third scan line G3, the fifth scan line G5, and the first scan line G1 are driven in accordance with the second driving sequence; the fifth scan line G5, the first scan line G1 and the third scan line G3 are driven in accordance with the third driving sequence, as shown in FIG. 7A to FIG. 7C.

In the embodiment, all scan lines of the liquid crystal display are driven in accordance with three driving sequences to sufficiently eliminate the horizontal lines and upgrade the display quality.

In the aforesaid embodiment, a display device may be a display panel with a QVGA resolution, the display panel includes 320 gate lines, respectively referred as G1 to G320. Taking FIG. 7A for example, a complete first driving sequence is G1, G3, and G5→G2, G4, and G6→G7, G9, and G11→G8, G10, and G12 . . . →G315, G317, and G319→G316, G318, and G320. Taking FIG. 7B for example, a complete second driving sequence is G3, G5, and G1→G4, G6, and G2→G9, G11, and G7→G10, G12, and G8 . . . →G317, G319, and G315→G318, G320, and G316. Taking FIG. 7C for example, a complete second driving sequence is G5, G1, and G3→G6, G2, and G4→G11, G7, and G9→G12, G8, and G10 . . . →G319, G315, and G317→G320, G316, and G318. However, it should be noted that the display device of the aforesaid embodiment is illustrative only, and not by way of limitation. For example, the display device may also be a VGA device with a resolution of 480 scan lines, a SVGA device with a resolution of 600 scan lines or an XVGA device with a resolution of 768 scan lines.

Figure 8:
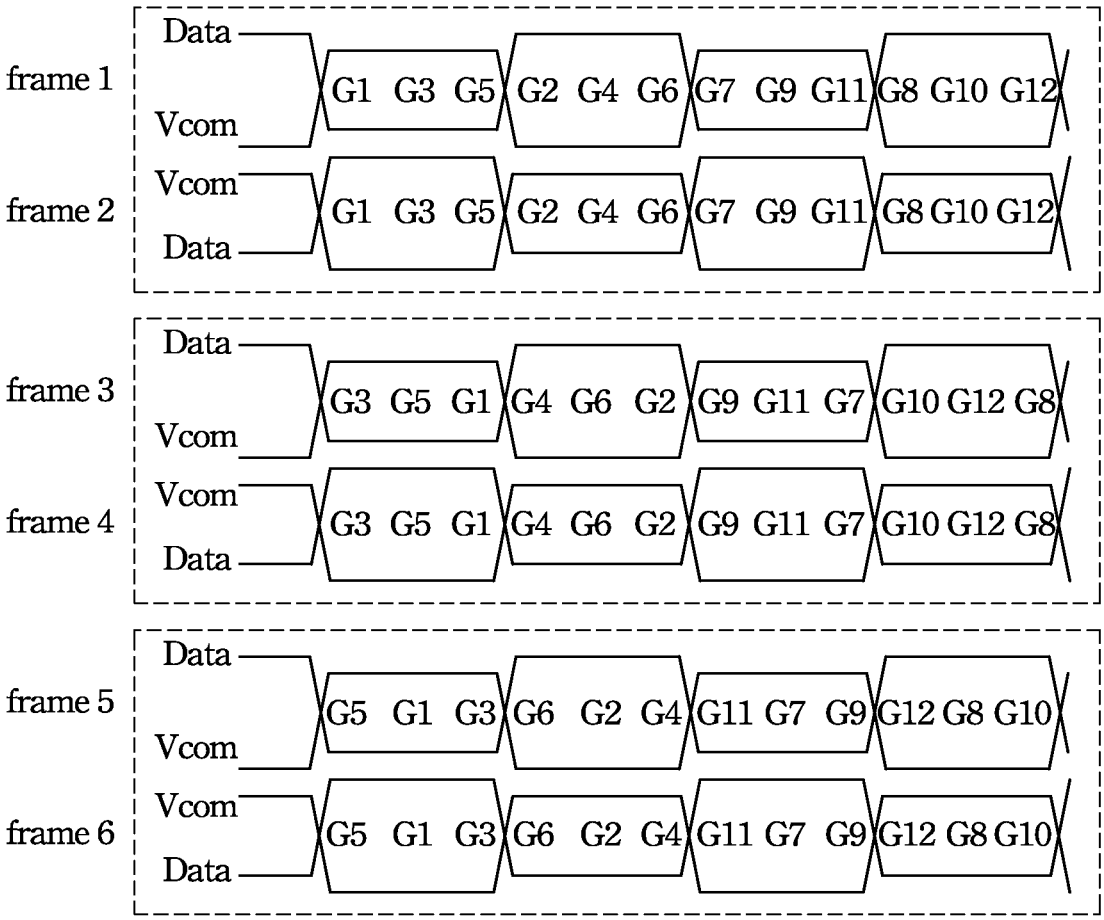
FIG. 8 is a schematic graph illustrating the variation of voltages in a display device in accordance with still another embodiment of the invention.

FIG. 8 is a schematic graph illustrating the variation of voltages in a display device in accordance with still another embodiment of the invention. It shows driving sequences of scan lines and voltage levels of a common voltage signal in Frame 1 to Frame 6. The scan lines G1 to G2 are driven with the first driving sequence during both the periods of Frame 1 and Frame 2, respectively with the second driving sequence during both Frame 3 and Frame 4 periods, and respectively with the third driving sequence during both Frame 5 and Frame 6 periods. During the periods of Frame1 and Frame 2, the voltage levels of a common voltage signal are reversed.

As shown in FIG. 8, the voltage level of a data signal voltage corresponding to the first scan line is high, and the voltage level of the common voltage signal is low in Frame 1, the voltage level of a data signal voltage corresponding to the first scan line is low, and the voltage level of the common voltage signal is high, so as to protect the liquid crystal molecule of the liquid crystal display from deterioration. The reverse voltage is implemented in other frames, such as Frame 3 and Frame 4, and Frame 5 and Frame 6, the related descriptions are omitted for the sake of simplicity.

Figure 9A:
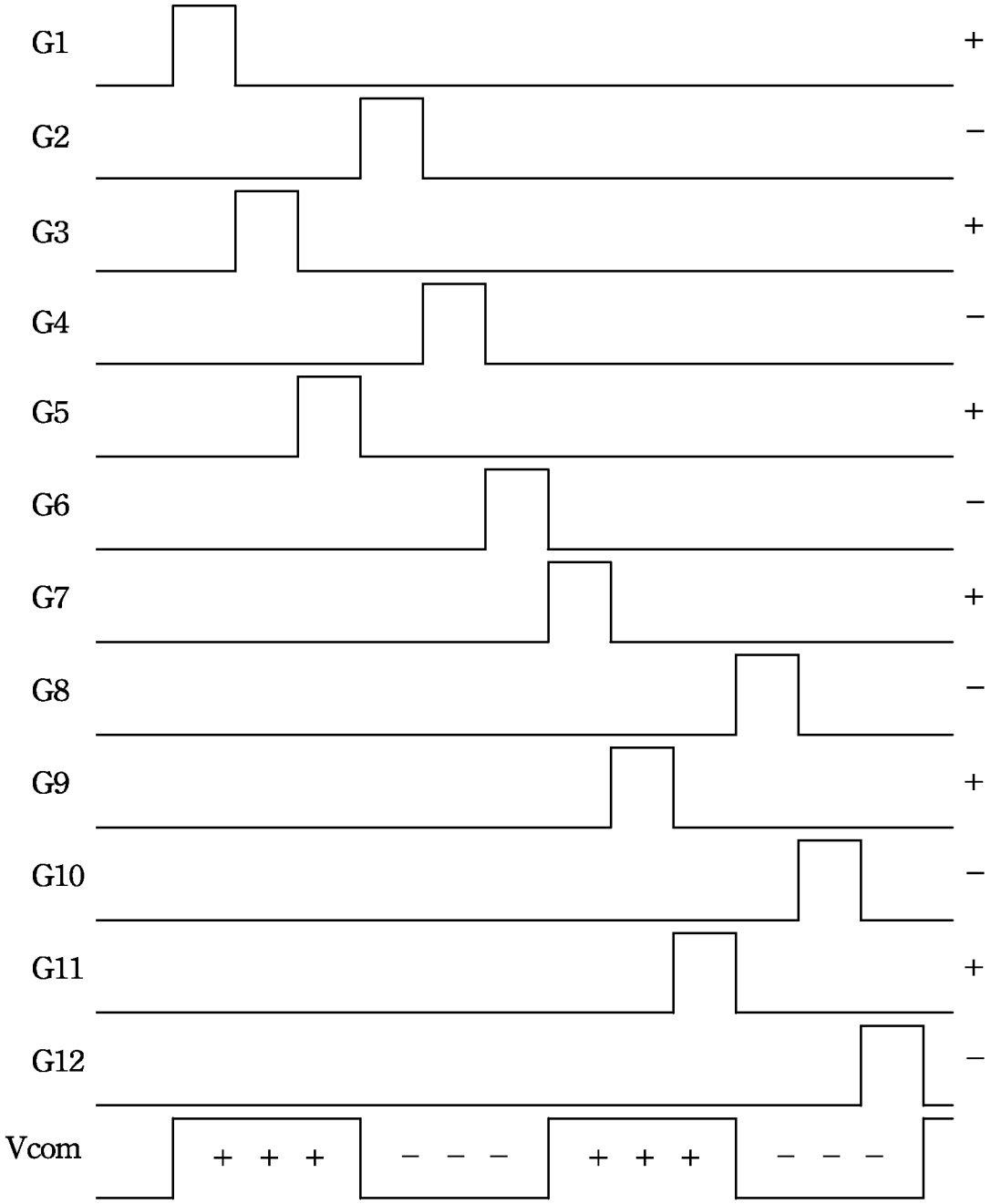
FIG. 9A is a timing diagram showing the method shown in FIG. 7A.
Figure 9B:
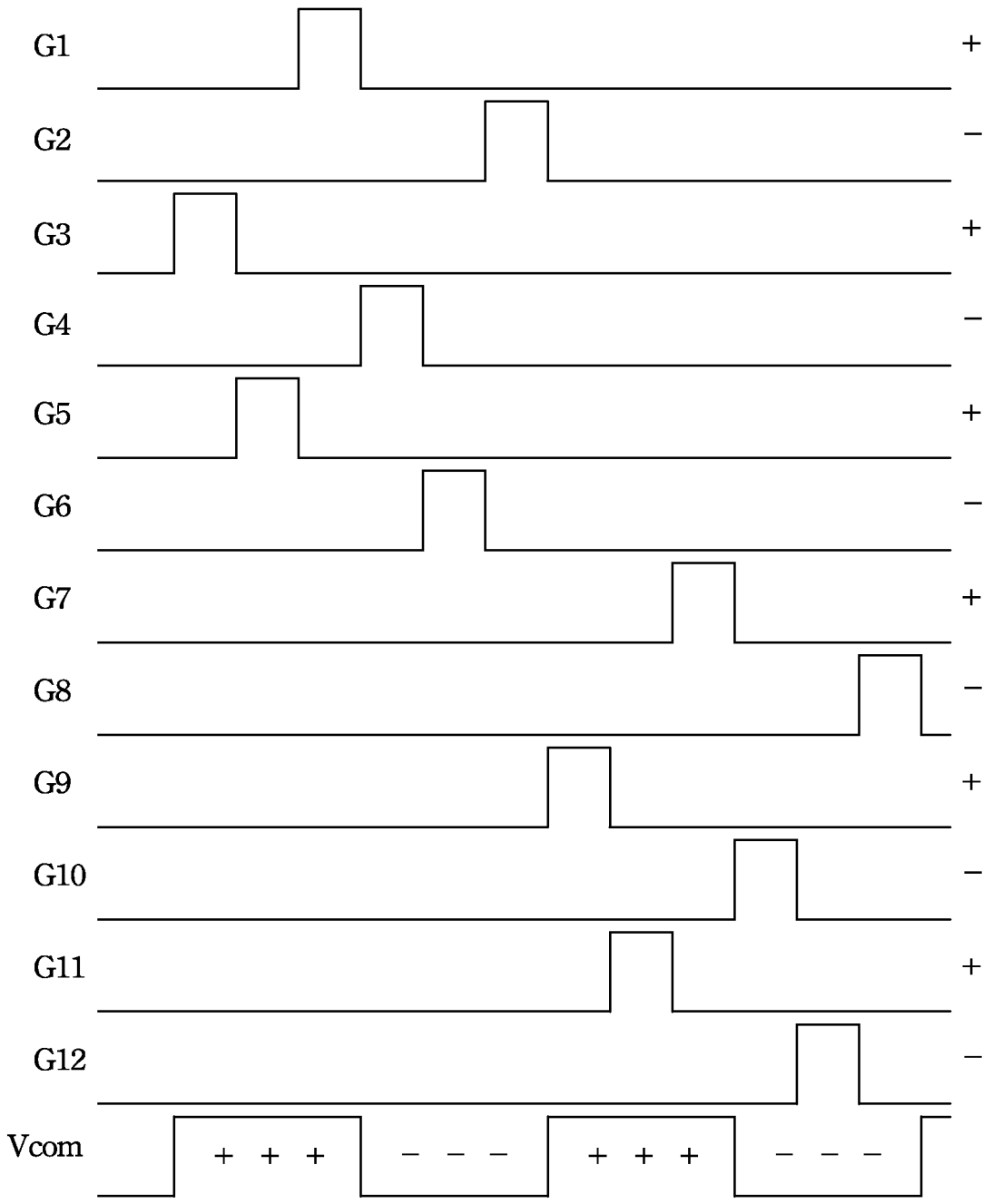
FIG. 9B is a timing diagram showing the method shown in FIG. 7B.
Figure 9C:
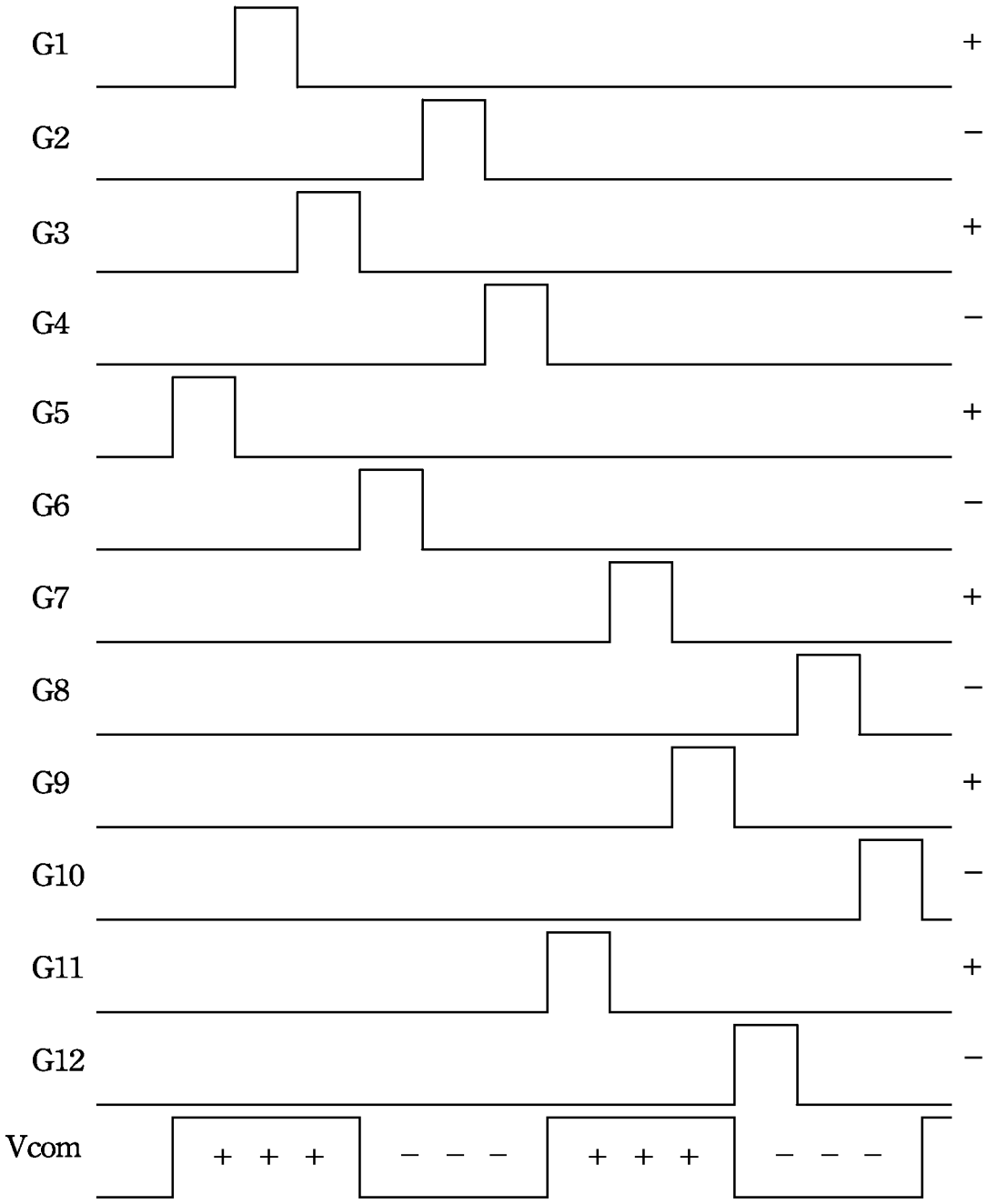
FIG. 9C is a timing diagram showing the method shown in FIG. 7C.

FIG. 9A is a timing diagram showing the method shown in FIG. 7A. FIG. 9B is a timing diagram showing the method shown in FIG. 7B. FIG. 9C is a timing diagram showing the method shown in FIG. 7C. With reference to FIG. 9A, FIG. 9B and FIG. 9C. The timing diagrams respectively show scanning signal voltages transmitted by the scan lines in accordance with the first, the second and the third driving sequences and the common voltage signals. The voltage level of the common voltage signal is reversed after each group is driven. For example, when the first scan line, the third scan line, the fifth scan line are sequentially driven in accordance with the first driving sequence, the voltage level of the common voltage signal is high. Afterward, when the second scan line, the fourth scan line, the sixth scan line are sequentially driven in accordance with the second driving sequence, the voltage level of the common voltage signal is low, and so on, until the driving operation for all scan lines is finished.

Namely, when scan lines are driven with the first, the second or the third driving sequences, the voltage level of the common voltage signal would be reversed. The reversed voltage level of the common voltage signal could protect the liquid crystal molecule of the liquid crystal display from deterioration.

On the other hand, in the embodiment shown in the FIG. 9A, FIG. 9B and FIG. 9C, the common voltage signal may be replaced with another common voltage signal, which also has different voltage levels. For example, in FIG. 9A, when the first scan line G1, the third scan line G3, and fifth scan line G5 are sequentially driven with the first driving sequence, the common signal with a low voltage level is provided to the pixels corresponding to the first scan line G1, the second scan line G3, and the third scan line G5. Afterward, when the second scan line G2, the fourth scan line G4 and the sixth scan line G6 are sequentially driven with the second driving sequence, the voltage level of the common voltage signal Vcom is switched to be high, and the common voltage signal Vcom is provided to the pixels corresponding to the three scan lines G2, G4 and G6 and so on, such that it is possible to protect the liquid crystal molecule of the liquid crystal display from deterioration.

Figure 10A:
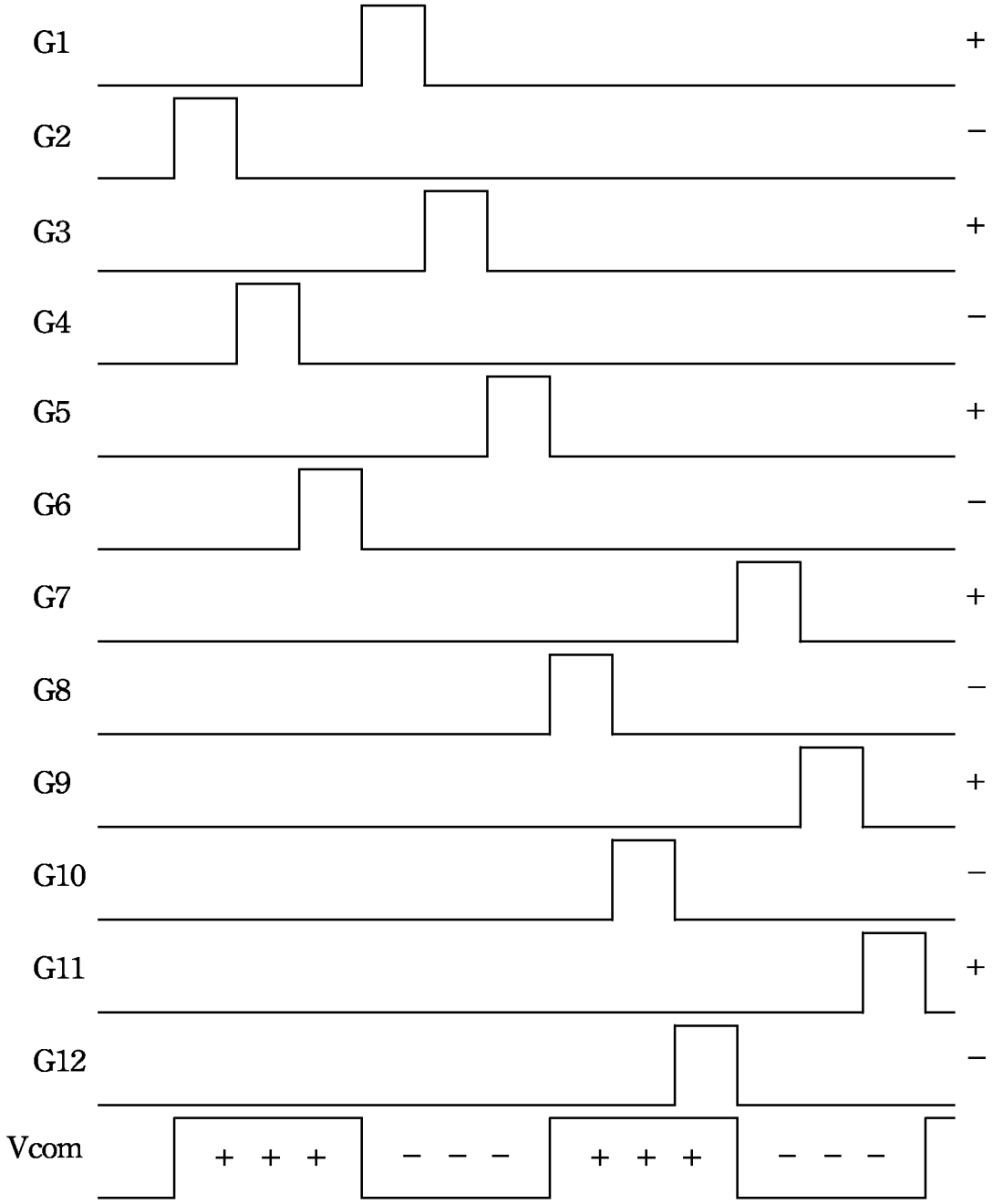
FIG. 10A is a timing diagram showing a method for driving a display device in accordance with the other embodiment of the invention.
Figure 10B:
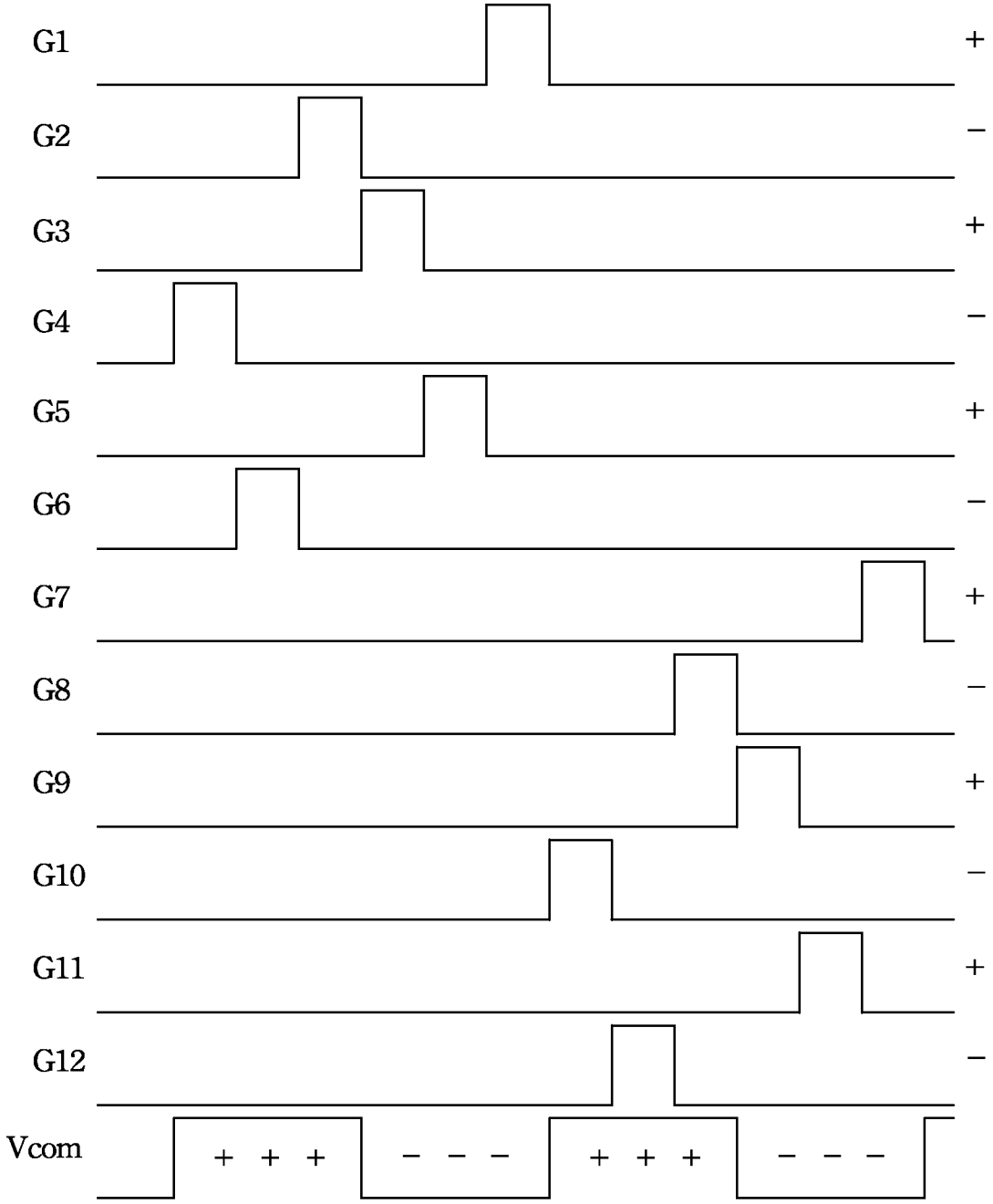
FIG. 10B is a timing diagram showing another method for driving a display device in accordance with the other embodiment of the invention.
Figure 10C:
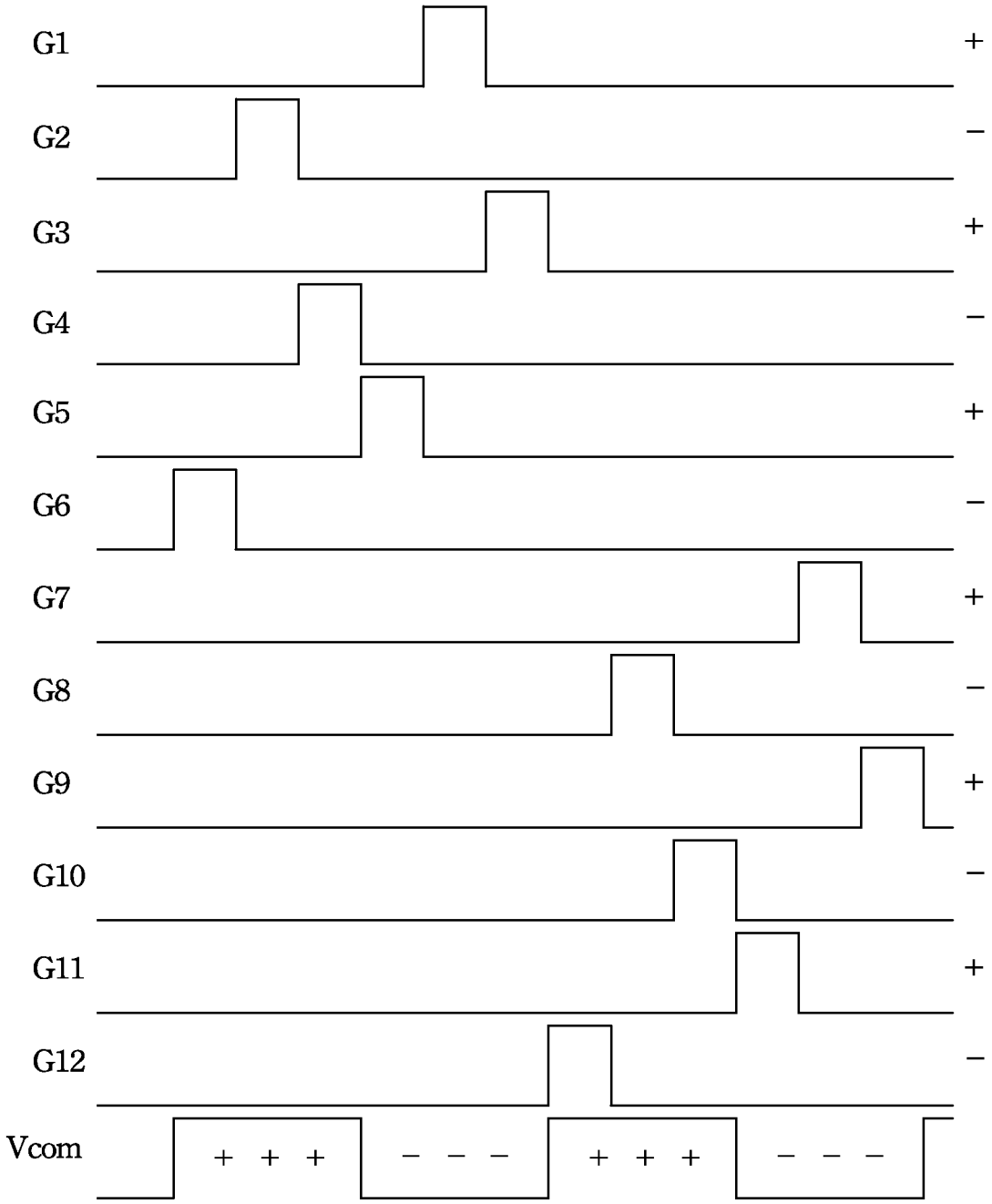
FIG. 10C is a timing diagram showing still another method for driving a display device in accordance with the other embodiment of the invention.

FIG. 10A is a timing diagram showing a method for driving a display device in accordance with the other embodiment of the invention. FIG. 10B is a timing diagram showing another method for driving a display device in accordance with the other embodiment of the invention. FIG. 10C is a timing diagram showing still another method for driving a display device in accordance with the other embodiment of the invention. Referring to FIG. 10A, during one frame period in the embodiment, the scan lines G1~G12 are sequentially driven in accordance with a first driving sequence. According to the first driving sequence, the second, the fourth, the sixth, the first, the third, the fifth, the eighth, the tenth, the twelfth, the seventh, the ninth, and the eleventh scan lines and so on are sequentially driven.

As shown in FIG. 10B, in the embodiment, the scan lines G1 to G12 are sequentially driven in accordance with a second driving sequence in another frame period in FIG. 10B. According to the second driving sequence, the fourth, the sixth, the second, the third, the fifth, the first, the tenth, the twelfth, the eighth, the ninth, the eleventh, and the seventh scan lines and so on are sequentially driven.

As shown in FIG. 10C, in the embodiment, the scan lines G1 to G12 are sequentially driven in accordance with a third driving sequence in the other frame period in FIG. 10C. According to the third driving sequence, the sixth, the second, the fourth, the fifth, the first, the third, the twelfth, the eighth, the tenth, the eleventh, the seventh, and the ninth scan lines and so on are sequentially driven.

In the embodiment, all scan lines on the liquid crystal display are sequentially driven with multiple driving sequences, the horizontal lines are substantially eliminated and the unevenness of image is prevented, thus the display quality is upgraded.

In the embodiment, the second and the fourth, the first and third, the sixth and eighth, and fifth and seventh scan lines belong to one group. After the scan lines of each group are driven, reversing the voltage level of the common voltage signal Vcom, until the driving operation for all scan lines is finished.

The common voltage signal Vcom shown in the FIGS. 10A, 10B and 10C is exemplary only, in the other embodiment, the common voltage signal can be replaced with another common voltage signal, which also have reversed voltage levels.

Figure 11:
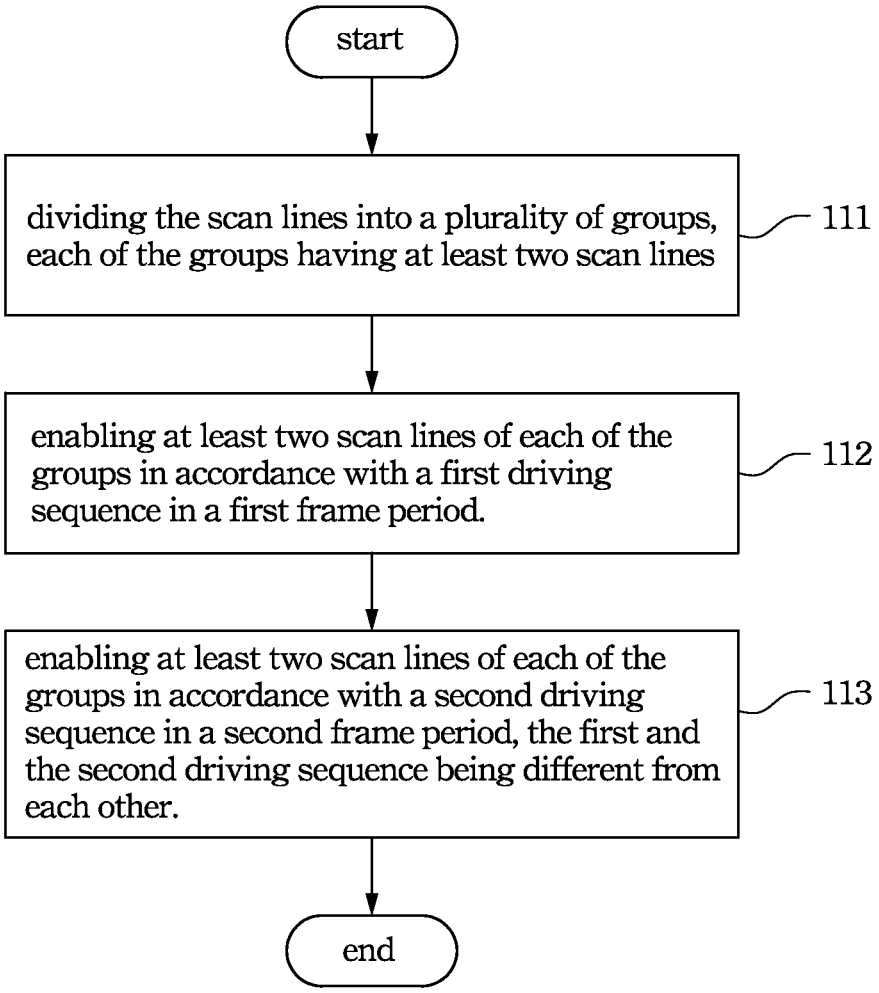
FIG. 11 is a flow chart of a method for driving a display device in accordance with one embodiment of the invention.

FIG. 11 is a flow chart of a method for driving a display device in accordance with one embodiment of the invention. In the embodiment, the method is meant to driving a liquid crystal display. The liquid crystal display includes a plurality of scan lines. First, in the step 111, dividing the scan lines into a plurality of groups, and each of the groups has at least two scan lines. Further, in the step 112, the scan lines of each of the groups are enabled in accordance with a first driving sequence in a first frame period. In the step 113, the scan lines of each of the groups are enabled in accordance with a second driving sequence in a second frame period, and the first driving sequence and the second driving sequence are different from each other.

Besides, in other embodiments, all scan lines are divided into a plurality of groups, each of the groups may have four, five, six . . . scan lines. The scan lines of each of the groups are sequentially driven respectively in accordance with a first to fourth, fifth and sixth driving sequences during different frame periods. Thus, the generation of horizontal lines is sufficiently avoided and the display quality is upgraded.

Compared with the horizontal lines resulted from the single driving sequence, the multiple driving sequence may reciprocate insufficiency of individual frames, prevent the generation of horizontal lines and greatly upgrade the display quality.

With aforesaid embodiments, the method for driving a display device of the invention implementing multiple driving sequences to drive all scan lines on the display device so as to sufficiently eliminate the horizontal lines and thus acquire a high display quality.

As described above, the display device and method of driving the display device both implement multiple driving sequences to sequentially drive sub-pixels associated with different primary colors, so as to eliminate the color shifting problem of the display device and acquire a high display quality.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

What is claimed is:

1. A method for driving a display device, the display device having a plurality of scan lines, the method comprising:

enabling a first scan line, a second scan line, and a third scan line sequentially from each of plural groups of the scan lines in accordance with a first driving sequence during both of an $n^{th}$ frame and an $(n+1)^{th}$ frame while a common voltage signal is reversed from the $n^{th}$ frame to the $(n+1)^{th}$ frame, wherein n is a positive integer;

enabling the second scan line, the third scan line, and the first scan line sequentially from each of the groups in accordance with a second driving sequence during both of an $(n+2)^{th}$ frame and an $(n+3)^{th}$ frame while the common voltage signal is reversed from the $(n+2)^{th}$ frame to the $(n+3)^{th}$ frame; and enabling the third scan line, the first scan line, and the second scan line sequentially from each of the groups in accordance with a third driving sequence during both of an $(n+4)^{th}$ frame and an $(n+5)^{th}$ frame while the common voltage signal is reversed from the $(n+4)^{th}$ frame to the $(n+5)^{th}$ frame, wherein the first driving sequence, the second driving sequence, and the third driving sequence are different from each other.

2. The method of claim 1, further comprising:

providing two common voltage signals with different voltage levels respectively in accordance with the two consecutive groups being enabled.

3. The method of claim 2, wherein the voltage levels of the common voltage signals for the two consecutive groups are changed during consecutive frame periods.

* * * * *